US008579376B2

(12) United States Patent
Chen

(10) Patent No.: US 8,579,376 B2
(45) Date of Patent: Nov. 12, 2013

(54) DEVICE FOR ADJUSTING THE HEIGHT OF THE BACKREST OF AN OFFICE CHAIR

(76) Inventor: Ching-Ming Chen, Taoyuan County (TW)

( * ) Notice: Subject to any disclaimer, the term of this patent is extended or adjusted under 35 U.S.C. 154(b) by 332 days.

(21) Appl. No.: 13/018,680

(22) Filed: Feb. 1, 2011

(65) Prior Publication Data

US 2012/0193962 A1 Aug. 2, 2012

(51) Int. Cl.
*A47C 7/40* (2006.01)

(52) U.S. Cl.
USPC ..... 297/353

(58) Field of Classification Search
USPC ..... 297/284.7, 353, 411.36
See application file for complete search history.

(56) References Cited

U.S. PATENT DOCUMENTS 5,597,204 A * 1/1997 Karaus, Jr. ..... 297/353
6,209,961 B1 * 4/2001 Chen ..... 297/411.36
6,343,840 B1 * 2/2002 Chuang ..... 297/411.36
6,572,190 B2 * 6/2003 Koepke et al. ..... 297/284.1
6,709,059 B1 * 3/2004 Cvek ..... 297/353
7,246,859 B2 * 7/2007 Igarashi et al. ..... 297/411.36
8,020,934 B2 * 9/2011 Hu ..... 297/353
8,272,691 B2 * 9/2012 Hsuan-Chin ..... 297/285
2005/0017560 A1 * 1/2005 Bastas ..... 297/353
2011/0215623 A1 * 9/2011 Tsai ..... 297/301.1

* cited by examiner

*Primary Examiner* — Peter Brown
(74) *Attorney, Agent, or Firm* — Rosenberg, Klein & Lee

(57) ABSTRACT

A device for adjusting the height of the backrest of an office chair having a backrest unit at the rear side of a seat body. The height adjustment may take place to achieve the optimal resting angle according to the different body shapes, personal requirements and needs of the users. In moving upward to adjust the height, an automatic engagement is achieved in the predetermined position. Moreover, an automatic return to the lowest position is achieved as well in reaching the highest position. It is done without any tools or control buttons and fulfills the requirements on the user-friendly operation and a practical use. In addition, a waistrest is located at the position of the waist of the user for providing an optimal resting comfort by means of the pivoted and telescopic structure.

6 Claims, 14 Drawing Sheets

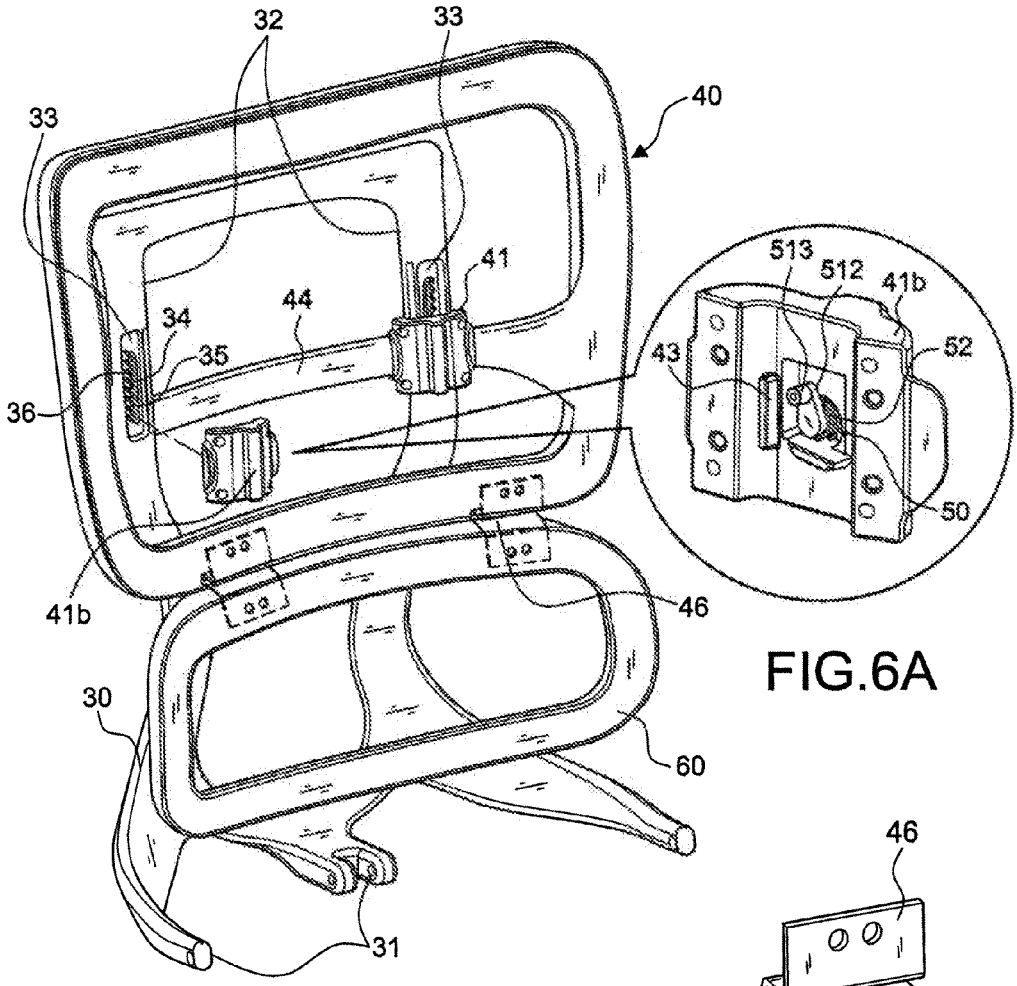
FIG.6A
FIG.6
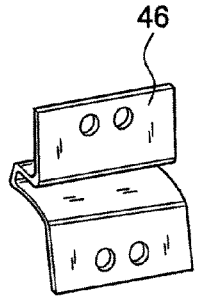
FIG.6B

DEVICE FOR ADJUSTING THE HEIGHT OF THE BACKREST OF AN OFFICE CHAIR

BACKGROUND OF THE INVENTION

1. Field of the Invention

The invention relates to a device for adjusting the height of the backrest of an office chair, and more particularly to a backrest and a waistrest both of which are height-adjustable and achieve an automatic drop in reaching a predetermined height.

2. Description of the Related Art

As shown in FIG. 1, a conventional office chair 10 includes a seat body 12 which is supported by an upright rod on a base 11 with a plurality of rollers. A seat back 13 is positioned upright at the tail of the seat body 12. An arched and streamlined headrest 15 is mounted at the top of the seat back 13 via a pair of support bars 14. The height of the headrest 15 is adjustable by the fixing position of the support bars 14 and the seat back 13. The optimal resting angle for the back and the neck depends on different body shapes, personal requirements and needs of the users when they sit on the chair. The conventional fixed type headrest design obviously fails to meet the above-mentioned requirements so that it is impractical.

Besides, the conventional office chair is often provided with a waistrest 16 on the seat back. The waistrest 16 is indirectly driven by a transmission set (not shown) within the seat back 13 to impart a telescopic movement to an internal frame plate. The drive position is located at the side of the seat back 13 such that the assembly and the operation will do great harm to the whole appearance of the chair. When not used and removed, it occupies a considerable mounting space. Moreover, the waistrest which is mounted and telescopically moved within the seat back is unable to achieve the expected supporting or resting effect due to the insufficient resilience and the too small distance of the telescopic drive movement. In addition, the waistrest mounted and telescopically moved within the seat back 13 requires the additional transmission set for driving an internal frame plate in a telescopic movement, thereby causing the cost burden of the component assembly.

According to U.S. Pat. No. 7,303,232B1 filed by the applicant of the invention, a "BACKREST ADJUSTING DEVICE FOR OFFICE CHAIRS" is disclosed for eliminating the drawbacks of the prior art. As shown in FIG. 2, a device for adjusting the angle of a waistrest 17 and for adjusting the height and the depth of the headrest 18 is provided to resolve the above-mentioned drawbacks and further to achieve the expected effects.

According to the above-mentioned conventional structure, the backrest 19 is ridigly attached to the seat body 12 such that the height thereof is not adjustable. As a result, it is not possible to adjust the chair to an optimal and ergonomic state according to the personal requirements. Thus, there is still room for improvement.

SUMMARY OF THE INVENTION

An object of the invention is to provide a device for adjusting the height of the backrest of an office chair through which the height adjustment may take place to achieve the optimal resting angle according to the different body shapes, personal requirements and needs of the users. In moving upward to adjust the height, an automatic engagement is achieved in the predetermined position. Moreover, an automatic return to the lowest position is achieved as well in reaching the highest position. It is done without any tools or control buttons and fulfills the requirements on the user-friendly operation and a practical use.

Another object of the invention is to provide a device for adjusting the height of the backrest of an office chair in which a waistrest is located at the place of the waist of the user for providing an optimal resting comfort by means of the pivoted and telescopic structure.

In order to achieve the above-mentioned objects, the invention includes:

a) a seat body having chair feet at the bottom thereof;

b) a frame body formed in an L shape, the bottom portion thereof being pivotally attached to the rear side of the seat body, the frame body having a left and right vertical portion, both of which are parallel to each other and located at the place facing to the back of the human body, a longitudinal slot being formed at the front or rear side of the vertical portions, a longitudinal projecting body being positioned at the center of the longitudinal slot such that an elongated ring-shaped turning slide is formed within the longitudinal slot by means of the longitudinal projecting body, one side of the longitudinal projecting body having a plurality of engaging teeth with the opening directed substantially upward;

c) a backrest unit mounted at the front side of the frame body and having at the rear side thereof two slide sleeves facing to the longitudinal slot of the frame body and movable up and down on the vertical portions, the slide sleeves each include a mounting hole at the side facing to the engaging teeth; and d) a engaging unit having an engaging body and a torsion spring, the engaging body having a shank and a crank at the front side of the shank, the end of the crank being provided with a projection insertable into the engaging teeth, the rear end of the shank fitting into the mounting hole of the slide sleeves, the torsion spring being mounted on the shank, the torsion spring having a front arm (resting on the surface of the crank) and a rear arm (fixed at the periphery of the mounting hole of the slide sleeves), wherein the crank of the engaging body is subject to a side resilience such that the projection at the end of the crank leans against the side of the longitudinal projecting body when the slide sleeves moves up and down;

wherein, when the projection rises to the prearranged position, the projection is engaged into the engaging teeth by means of the resilience of the torsion spring;

wherein, when the projection rises to the top of the longitudinal projecting body, it falls down in a(n) natural and unhindered way along the side opposite to the engaging teeth, whereby the height of the backrest unit is adjustable from a lower position to a higher position, and, when the projection reaches the highest position, it will automatically fall back to the lowest position, and the height adjustment may be done according to the requirement of the user once again.

According to the invention, the frame body includes an elongated groove beside and parallel to the longitudinal slot. The slide sleeve includes a slipper corresponding to (and fitting into) the elongated groove such that the slide sleeve of the backrest unit can be stably and longitudinally movable on the frame body.

According to the invention, the slide sleeve of the backrest unit consists of an external clamping portion and an internal clamping portion. Both sides of the external clamping portion are connected to a crossbar extending to an external frame of the backrest unit. After the torsion spring is received within the mounting hole, the internal clamping portion is secured to the external clamping portion in such a way that the vertical portion of the frame body is clamped between the external and internal clamping portions.

According to the invention, the external frame of the backrest unit is provided with two spring elements at the bottom thereof. A waistrest is pivotally connected to the bottom of the spring elements such that the waistrest elastically rests on the spring elements and is swivelable to and fro by use of the spring elements.

BRIEF DESCRIPTION OF THE DRAWINGS

The accomplishment of this and other objects of the invention will become apparent from the following descriptions and its accompanying figures of which:

FIG. 6 is a perspective view of a backrest unit in accordance with the invention;

FIG. 6A is an enlarged view of an internal clamping portion in FIG. 6 seen from another side;

FIG. 6B is a perspective view of a spring element in FIG. 6;

DETAILED DESCRIPTION OF THE PREFERRED EMBODIMENT

Figure 1:
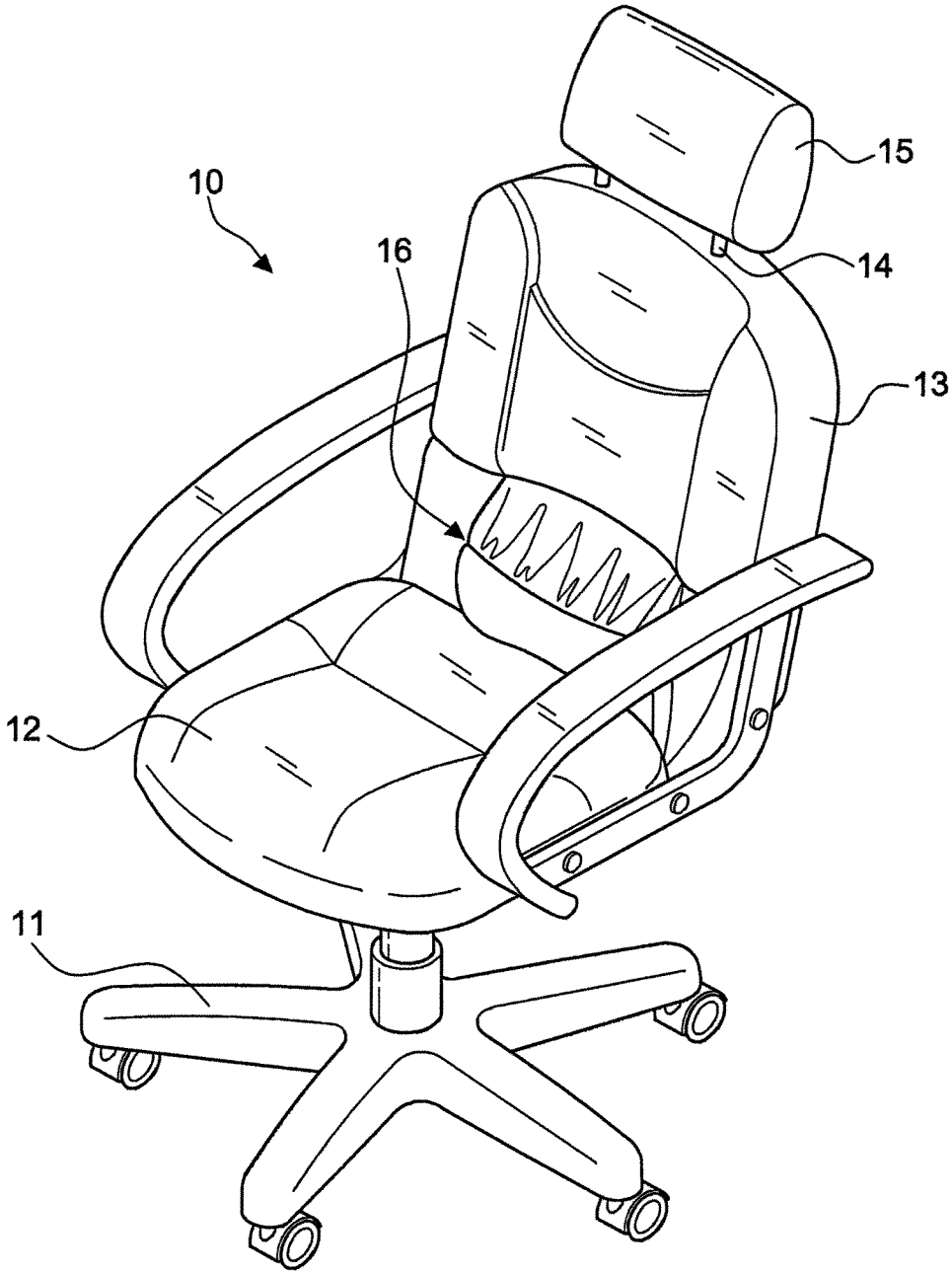
FIG.1 PRIOR ART
FIG. 1 is a perspective view of a conventional office chair.
Figure 2:
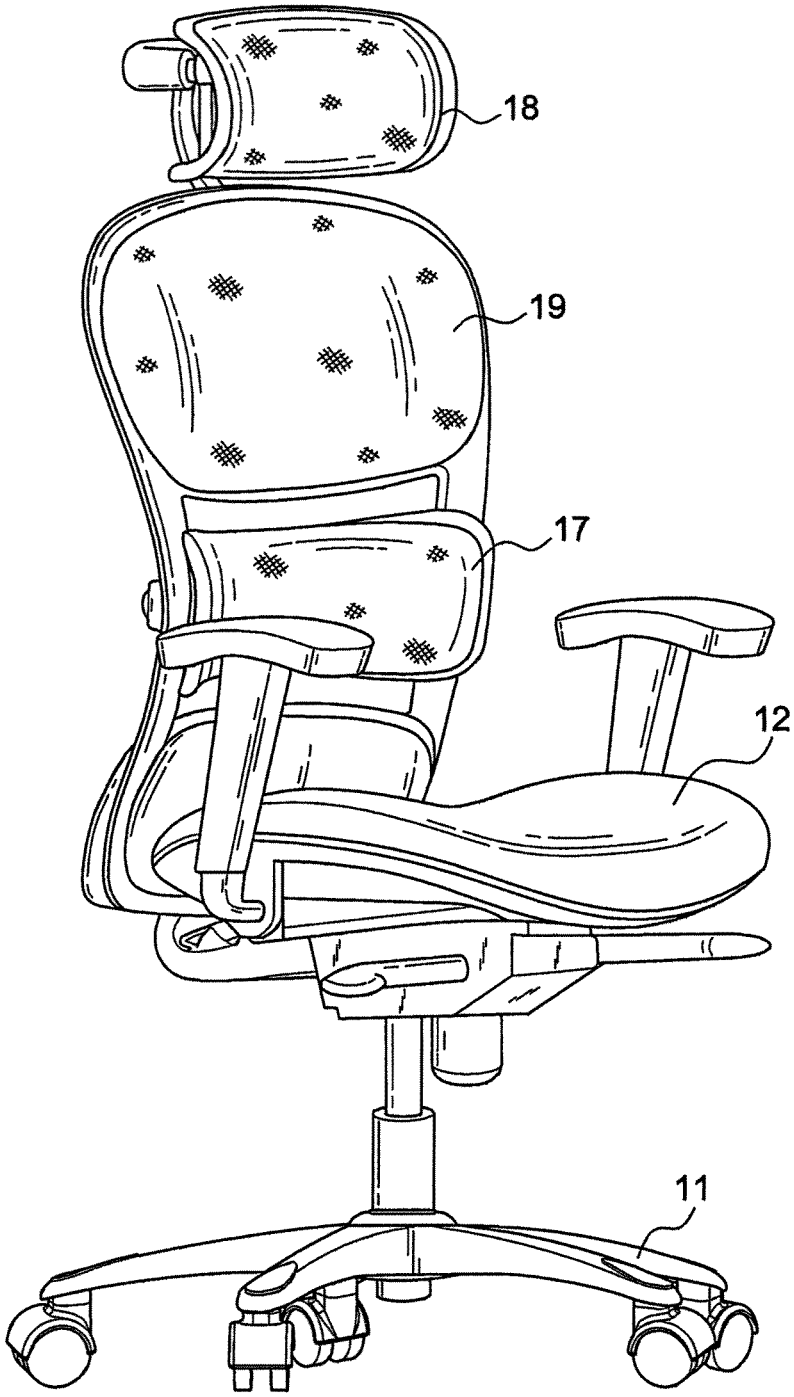
FIG.2 PRIOR ART
FIG. 2 is a perspective view of another conventional office chair.
Figure 3:
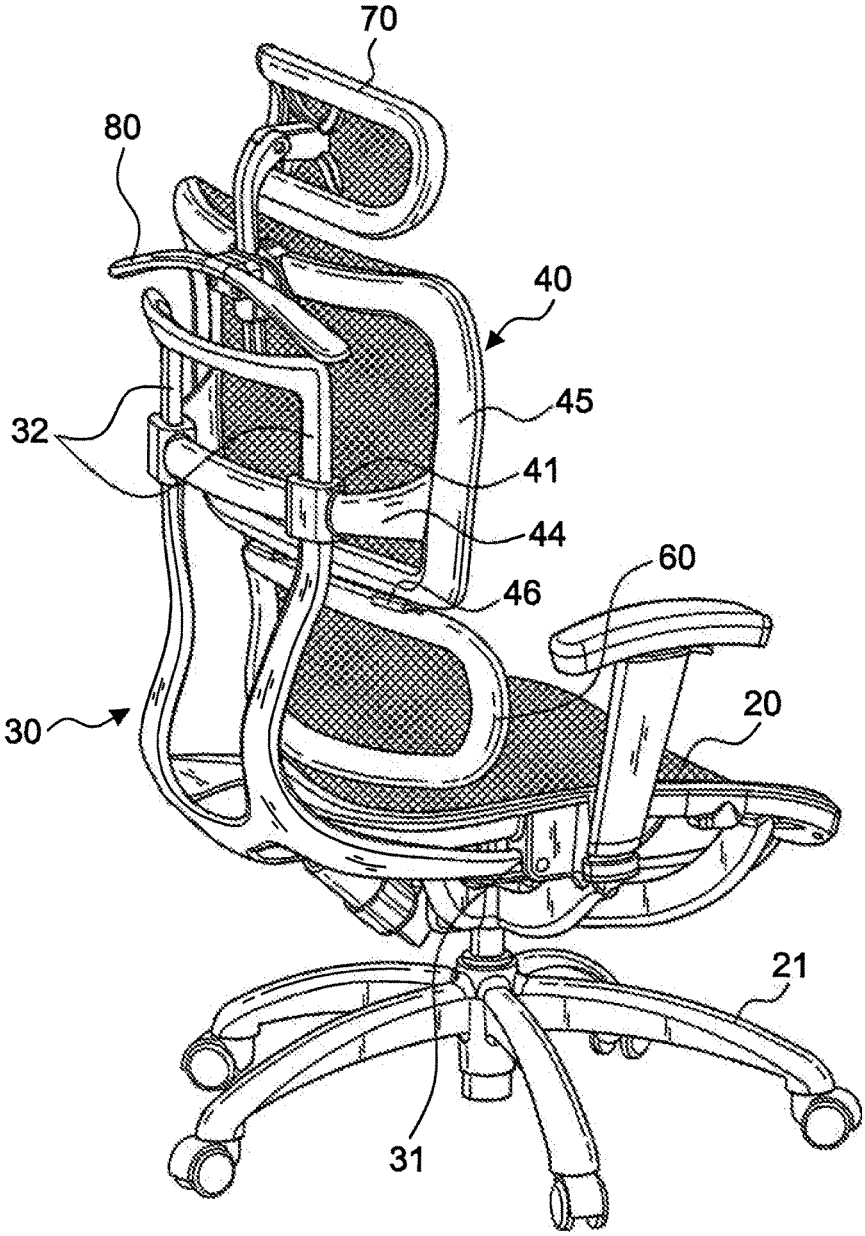
FIG. 3 is a perspective view of a preferred embodiment of the invention.
Figure 4:
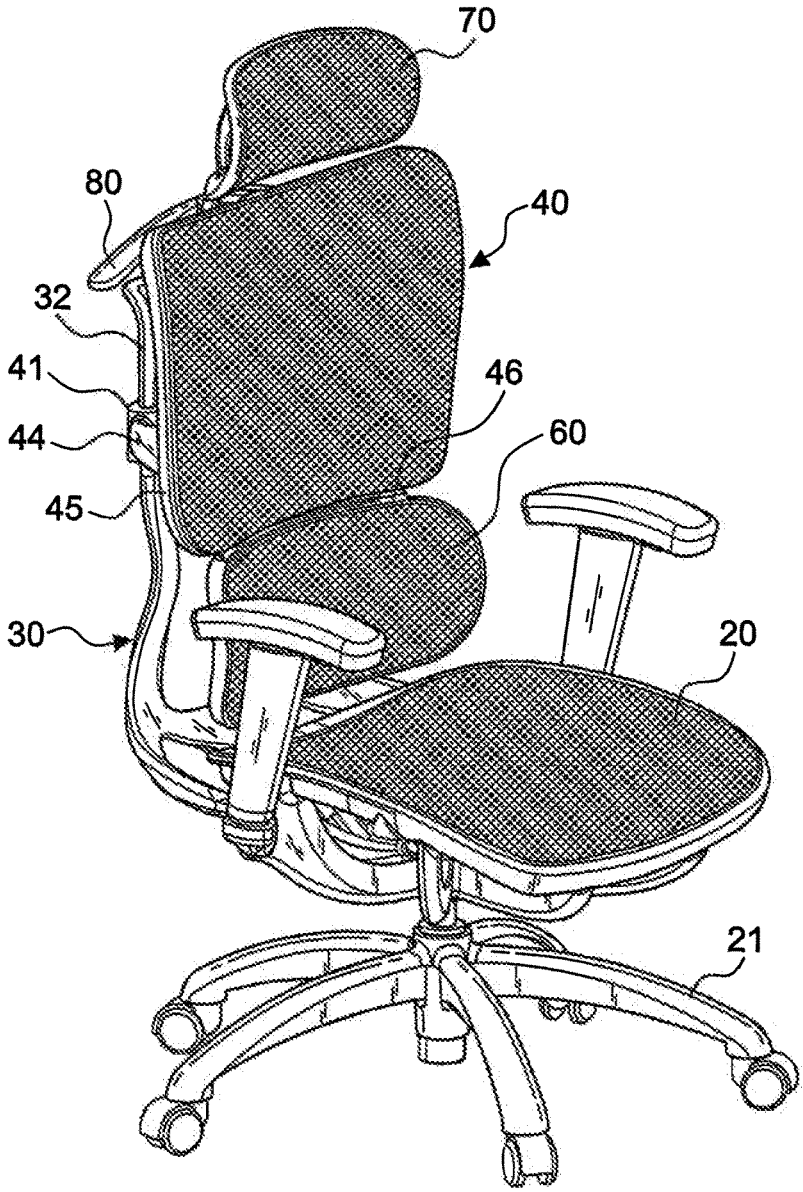
FIG. 4 is a perspective view of the preferred embodiment of the invention seen from another side.
Figure 5A:
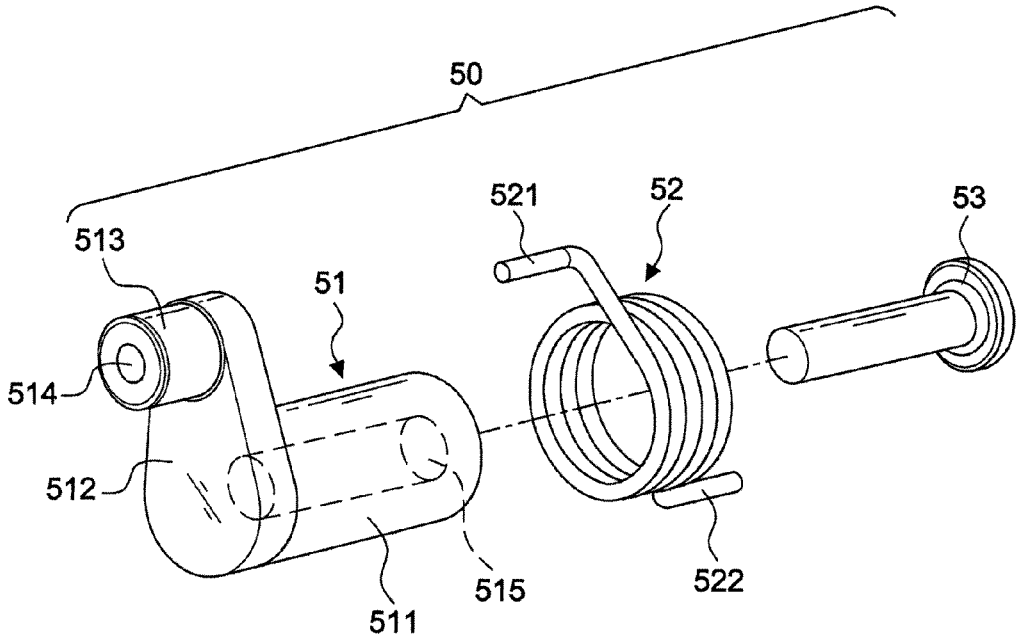
FIG. 5A through 5C are exploded perspective views and an assembly view of the engaging unit of the invention.
Figure 5B:
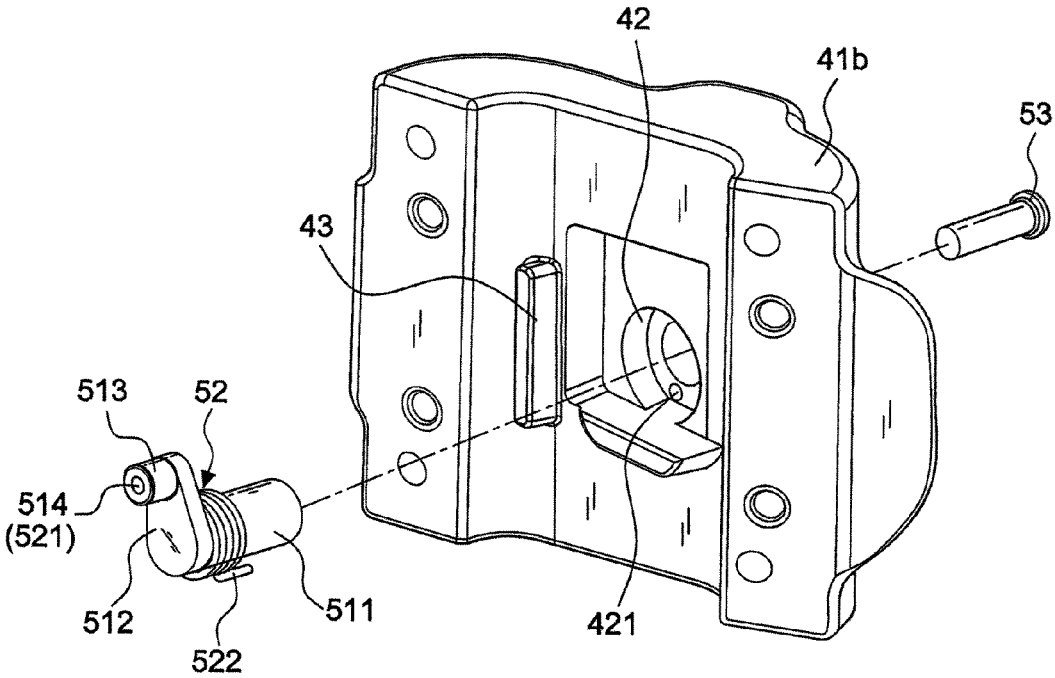
Figure 5C:
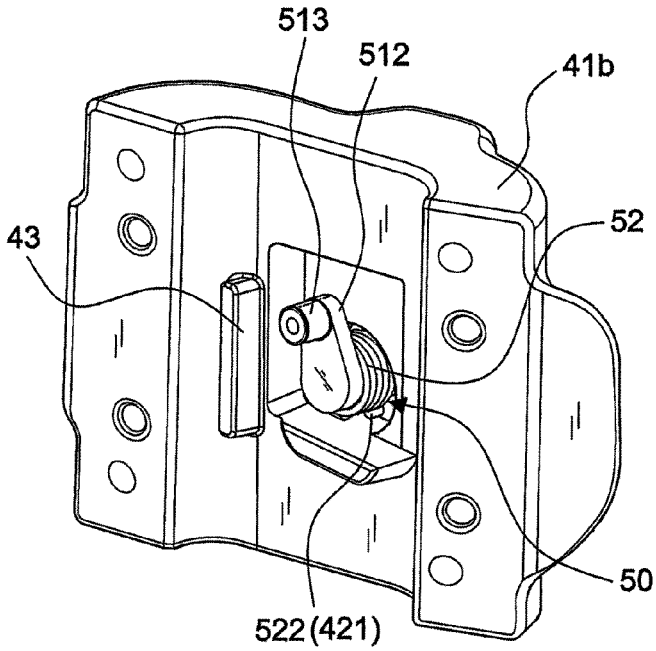

First of all, referring to FIGS. 3 through 13, an embodiment of the device for adjusting the height of the backrest of an office chair in accordance with the invention includes a seat body 20, a frame body 30, and backrest unit 40, and a engaging unit 50.

The seat body 20 includes chair feet 21 at the bottom thereof.

The frame body 30 is formed in an L shape. The bottom portion 31 thereof is pivotally attached to the rear side of the seat body 20. The frame body 30 includes a left and right vertical portion 32 both of which are parallel to each other and located at the place facing to the back of the human body. A longitudinal slot 33 is formed at the front or rear side of the vertical portions 32. A longitudinal projecting body 34 is positioned at the center of the longitudinal slot 33. An elongated ring-shaped turning slide 35 is formed within the longitudinal slot 33 by means of the longitudinal projecting body 34. One side of the longitudinal projecting body 34 includes a plurality of engaging teeth 36 with the opening substantially directed upward.

The backrest unit 40 is mounted at the front side of the frame body 30 and includes at the rear side thereof two slide sleeves 41 facing to the longitudinal slot 33 of the frame body 30 and movable up and down on the vertical portions 32. The slide sleeves 41 each include a mounting hole 42 at the side facing to the engaging teeth 36.

The engaging unit 50 includes an engaging body 51 and a torsion spring 52. The engaging body 51 has a shank 511 and a crank 512 at the front side of the shank 511. The end of the crank 512 is provided with a projection 513 insertable into the engaging teeth 36. Moreover, the rear end of the shank 511 enters into the mounting hole 42 of the slide sleeves 41. According to the embodiment, the shank 511 has a plug hole 515 into which a positioning plug 53 fits such that the shank 511 may rotate on the positioning plug 53. The torsion spring 52 is mounted on the shank 511. The torsion spring 52 has a front arm 521 fixed in a through hole 514 of the crank 512 and a rear arm 522 entering into a locating hole 421 adjacent to the mounting hole 42 of the slide sleeves 41. In this way, the crank 512 of the engaging body 51 is subject to a side resilience such that the projection 513 at the end of the crank 512 leans against the side of the longitudinal projecting body 34 when the slide sleeves 41 moves up and down. When the projection 513 rises to the prearranged position, the projection 513 is engaged into the engaging teeth 36 by means of the resilience of the torsion spring 52. Moreover, when the projection 513 rises to the top of the longitudinal projecting body 34, it falls down in a(n) natural and unhindered way along the side opposite to the engaging teeth 36. As a result, the height of the backrest unit 40 is adjustable from a lower position to a higher position. When the projection 513 reaches the highest position, it will automatically fall back to the lower position. The height adjustment may be done according to the requirement of the user once again.

Figure 9:
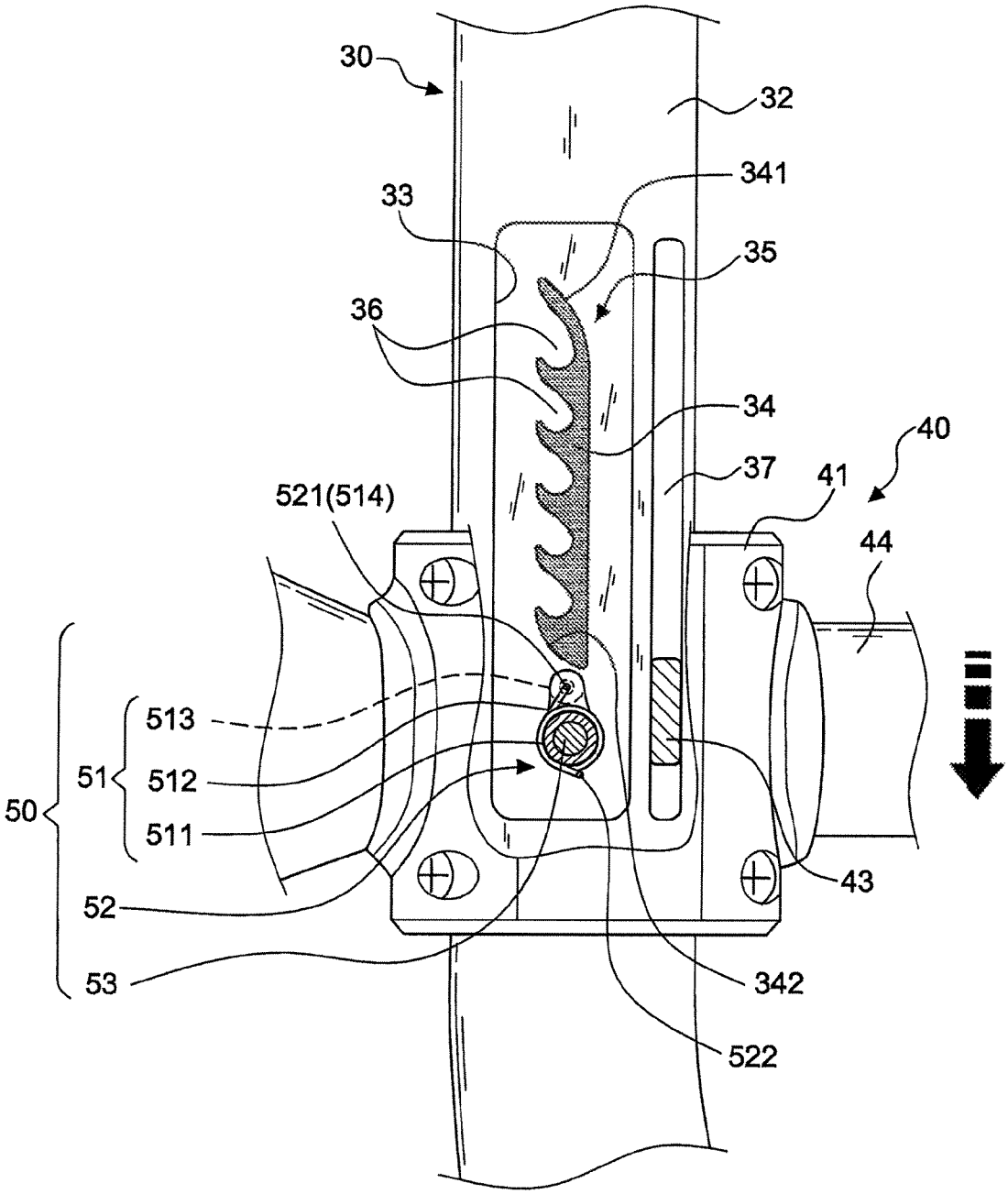
FIG. 9 is a cross-sectional view taken along the line 9-9 in FIG. 8.

As shown in FIGS. 6 and 9, the frame body 30 includes an elongated groove 37 beside and parallel to the longitudinal slot 33. The slide sleeve 41 includes a slipper 43 corresponding to (and fitting into) the elongated groove 37 such that the slide sleeve 41 of the backrest unit 40 can be stably and longitudinally movable on the frame body 30.

According to the embodiment, the slide sleeve 41 of the backrest unit 40 consists of an external clamping portion 41*a* and an internal clamping portion 41*b*. Both sides of the external clamping portion 41*a* are connected to a crossbar 44 extending to an external frame 45 of the backrest unit 40. After the torsion spring 52 is received within the mounting hole 42, the internal clamping portion 41*b* is secured to the external clamping portion 41*a* in such a way that the vertical portion 32 of the frame body 30 is clamped between the external and internal clamping portions 41*a*, 41*b*.

Figure 7:
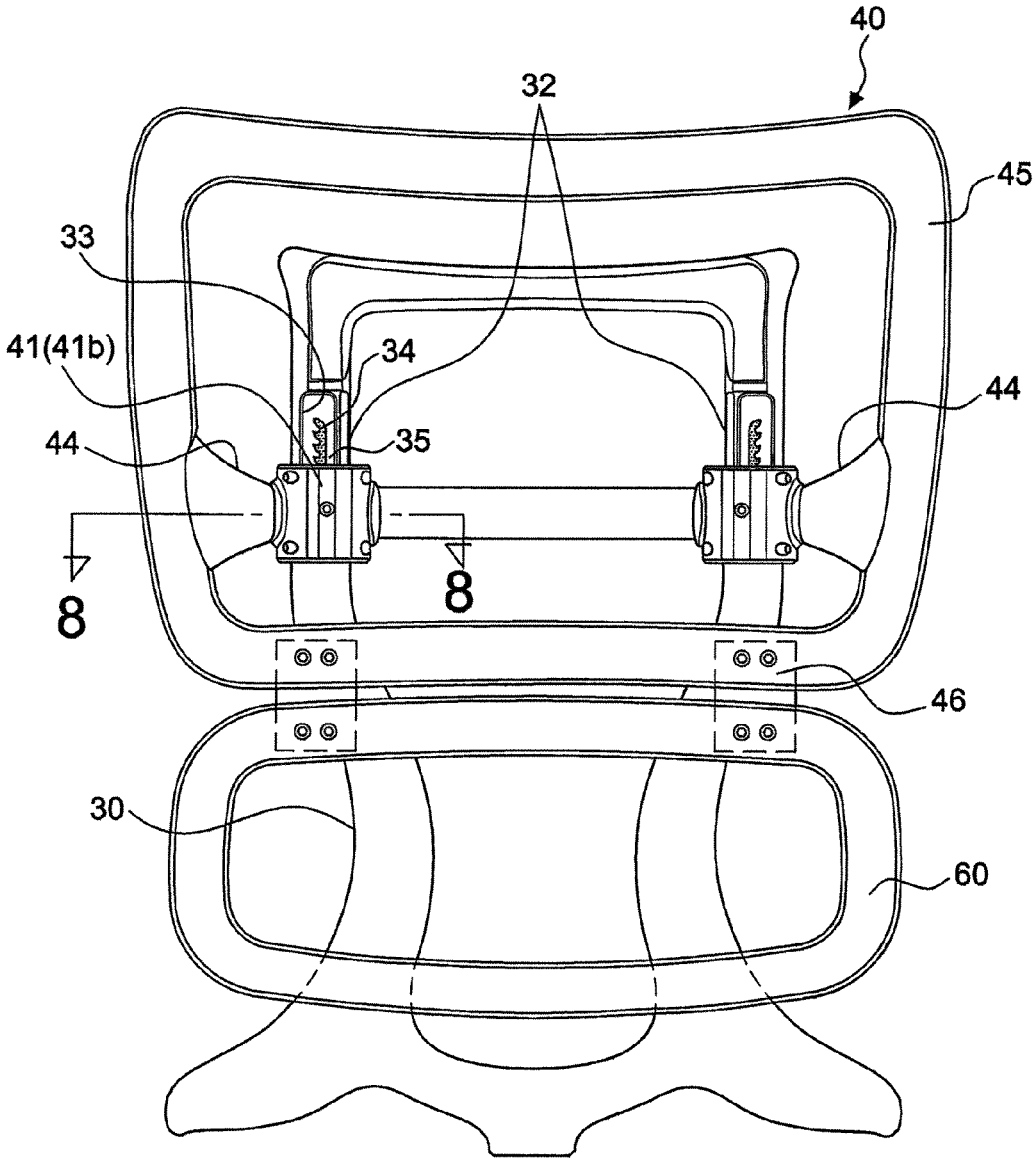
FIG. 7 is a schematic drawing of the backrest unit in accordance with the invention.
Figure 8:
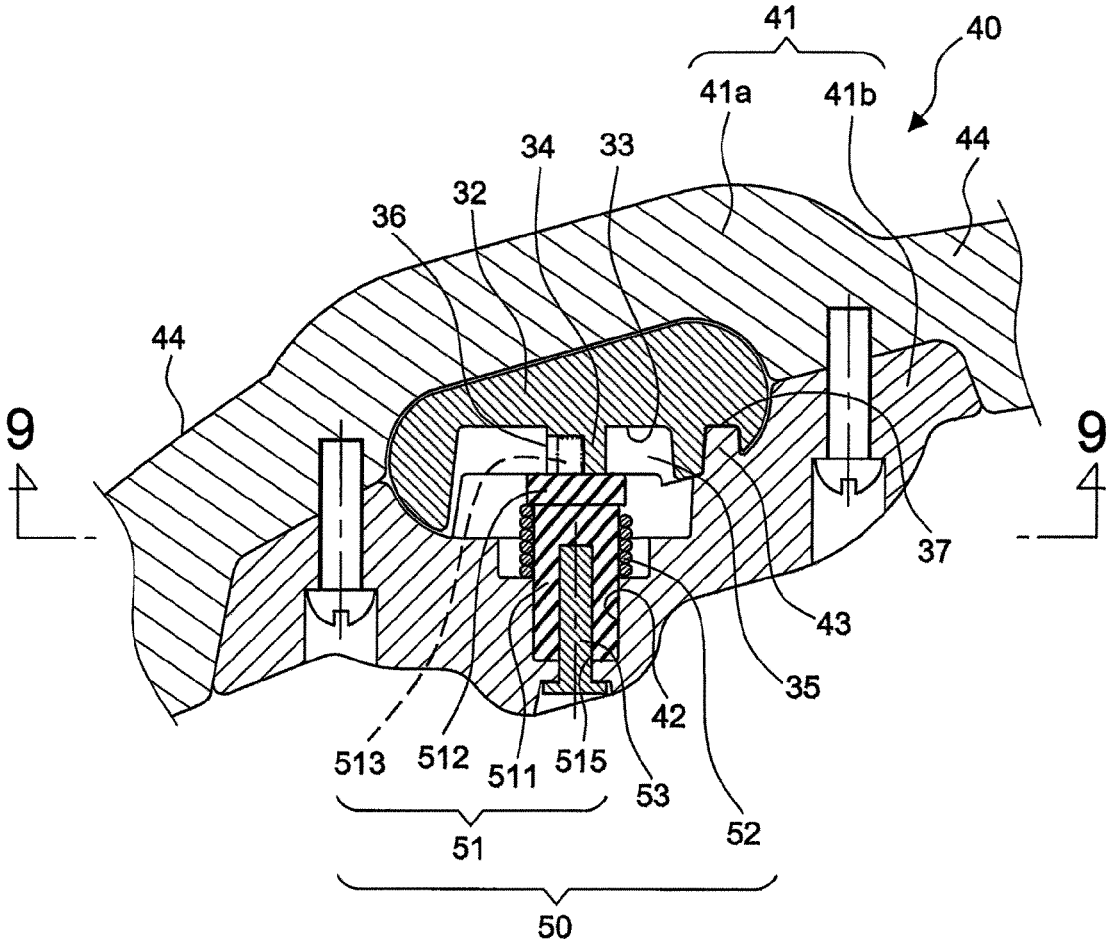
FIG. 8 is a cross-sectional view taken along the line 8-8 in FIG. 7.
Figure 13:
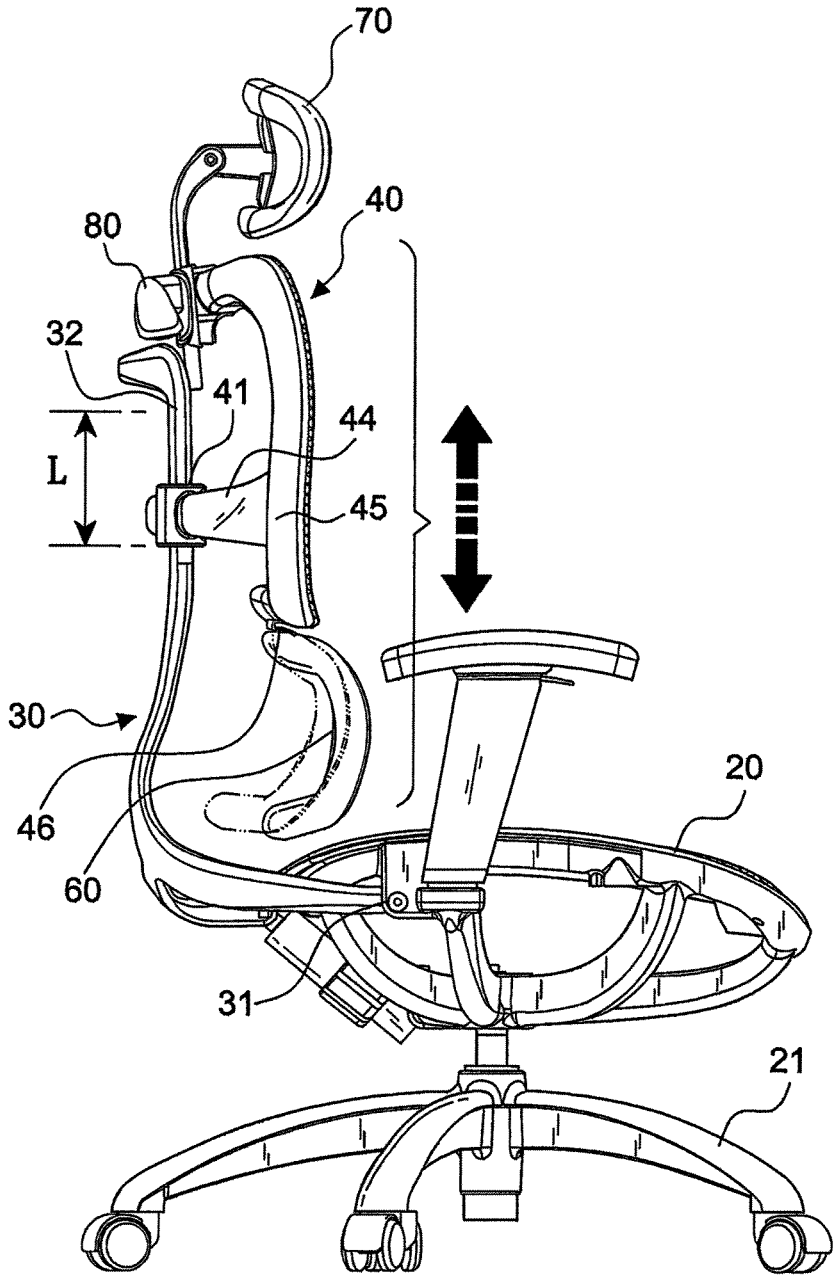
FIG. 13 is a side view of the invention showing the adjustment range.

As shown in FIGS. 6, 7, and 13, the external frame 45 is provided with two spring elements 46 at the bottom thereof A waistrest 60 is pivotally connected to the bottom of the spring elements 46 such that the waistrest 60 elastically rests on the spring elements 46 and is swivelable to and fro by use of the spring elements 46. According to the embodiment, the spring elements 46 are formed as curved spring leaf, but should not be restricted thereto. Alternatively, it can also be a torsion spring.

Furthermore, the backrest unit 40 includes a headrest 70 at the top thereof while a coat hanger 80 is attached to the back of the headrest 70, but should not be restricted thereof. Other objects may be provided for meeting different requirements.

The greatest feature of the invention is the height-adjusting design of the backrest unit 40. Based upon the above-mentioned structure, the adjustment of the invention is done as shown in FIGS. 9 through 13:

As shown in FIG. 9, the backrest unit 40 is located at the lowest position while the projection 513 of the engaging unit 50 is situated at the bottom of the longitudinal projecting body 34.

Figure 10:
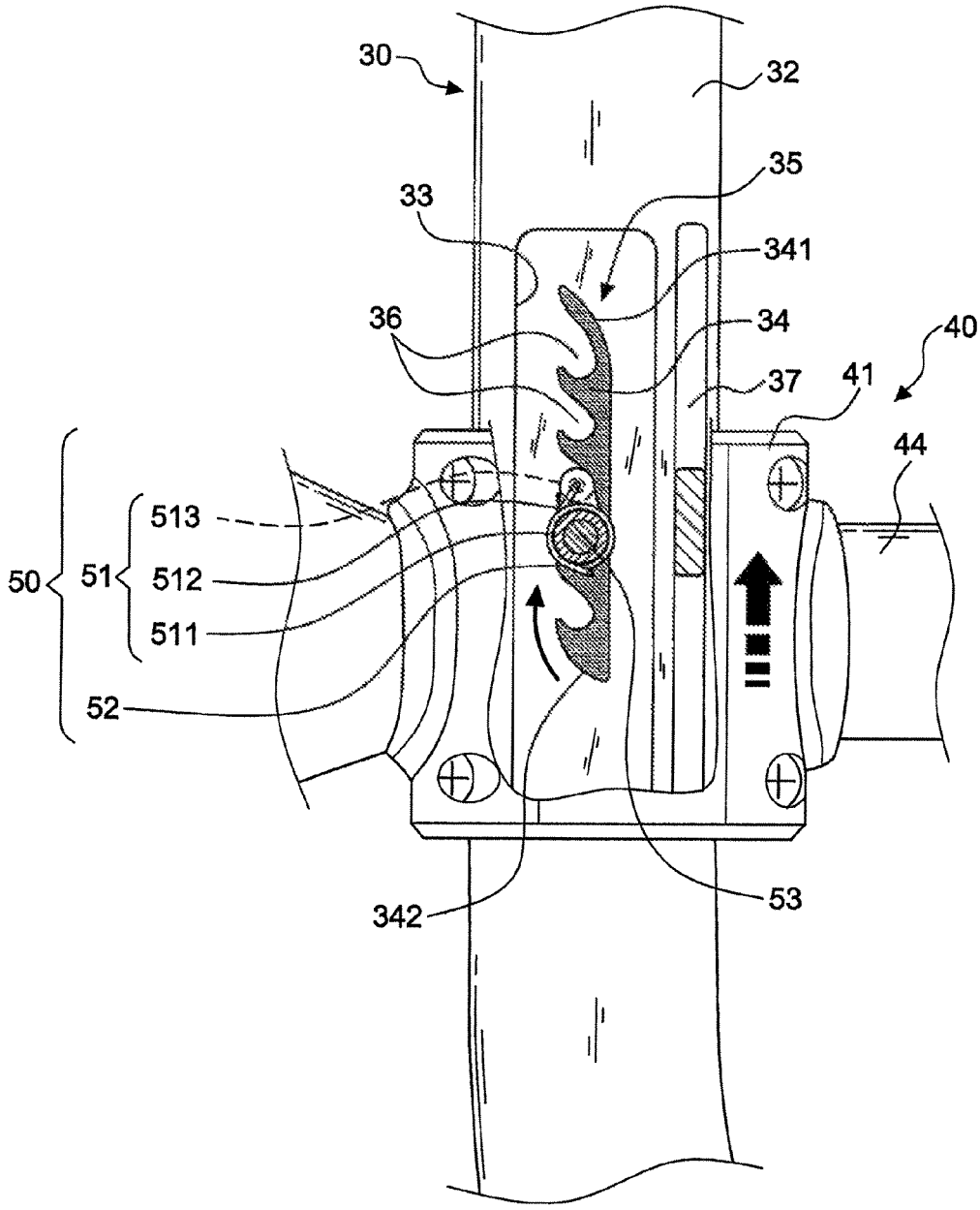
FIG. 10 is a schematic view showing that the engaging unit moves upward.

As shown in FIG. 10, the backrest unit 40 is moved upward to adjust its height. When it reaches the predetermined height, it is only required to stop it. At that time, the projection 513 is engaged into the engaging teeth 36 by means that the crank 512 and the projection 513 of the engaging unit 50 are subject to the resilient force of the torsion spring 52. Moreover, the engaging teeth 36 are directed substantially to the top such that an engagement is created when the projection 513 drops into the groove between teeth. In this way, the slide sleeve 41 won't fall down. Meanwhile, it can still move upward to adjust the height thereof.

Figure 11:
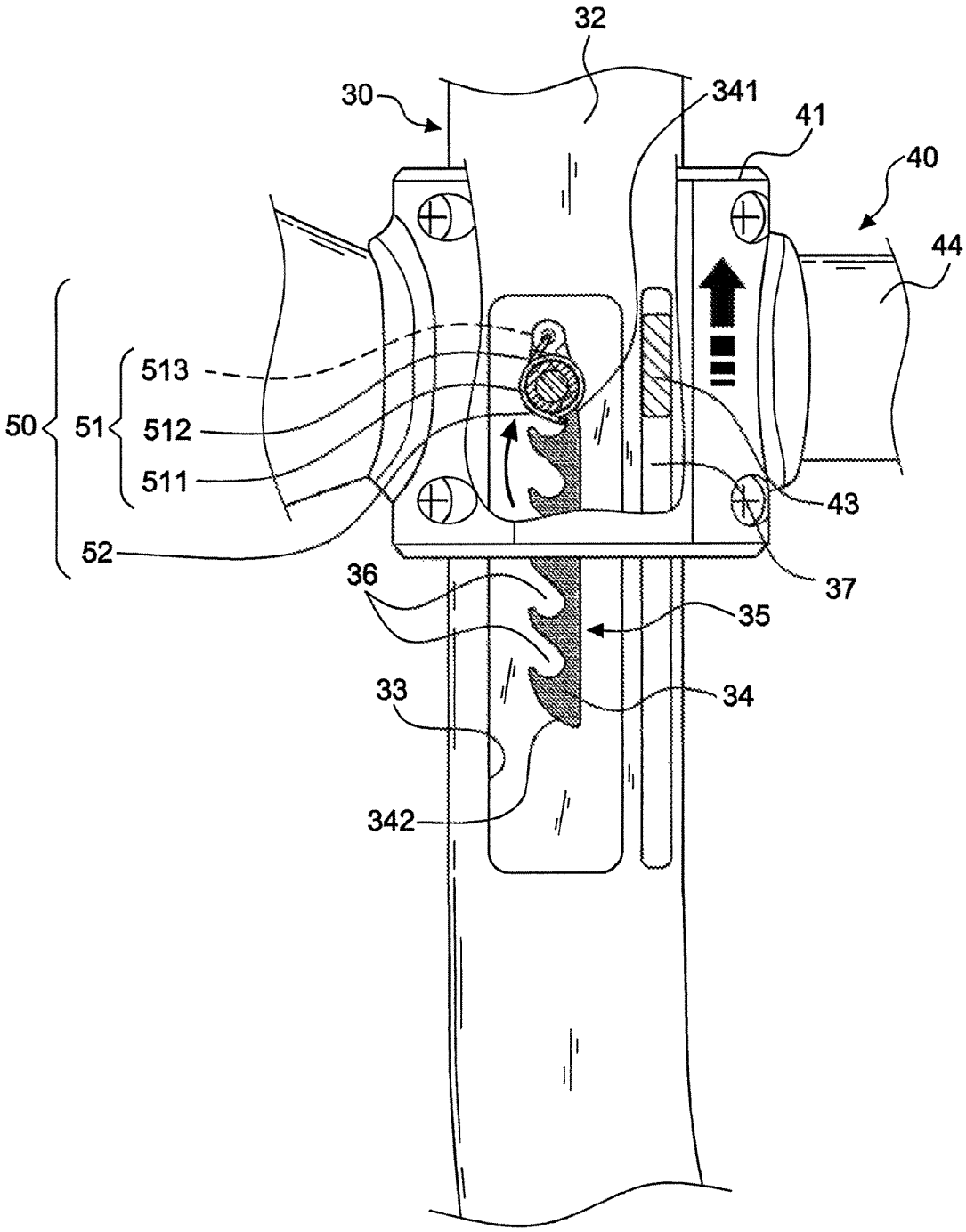
FIG. 11 is a schematic view showing that the engaging unit travels to the top.
Figure 12:
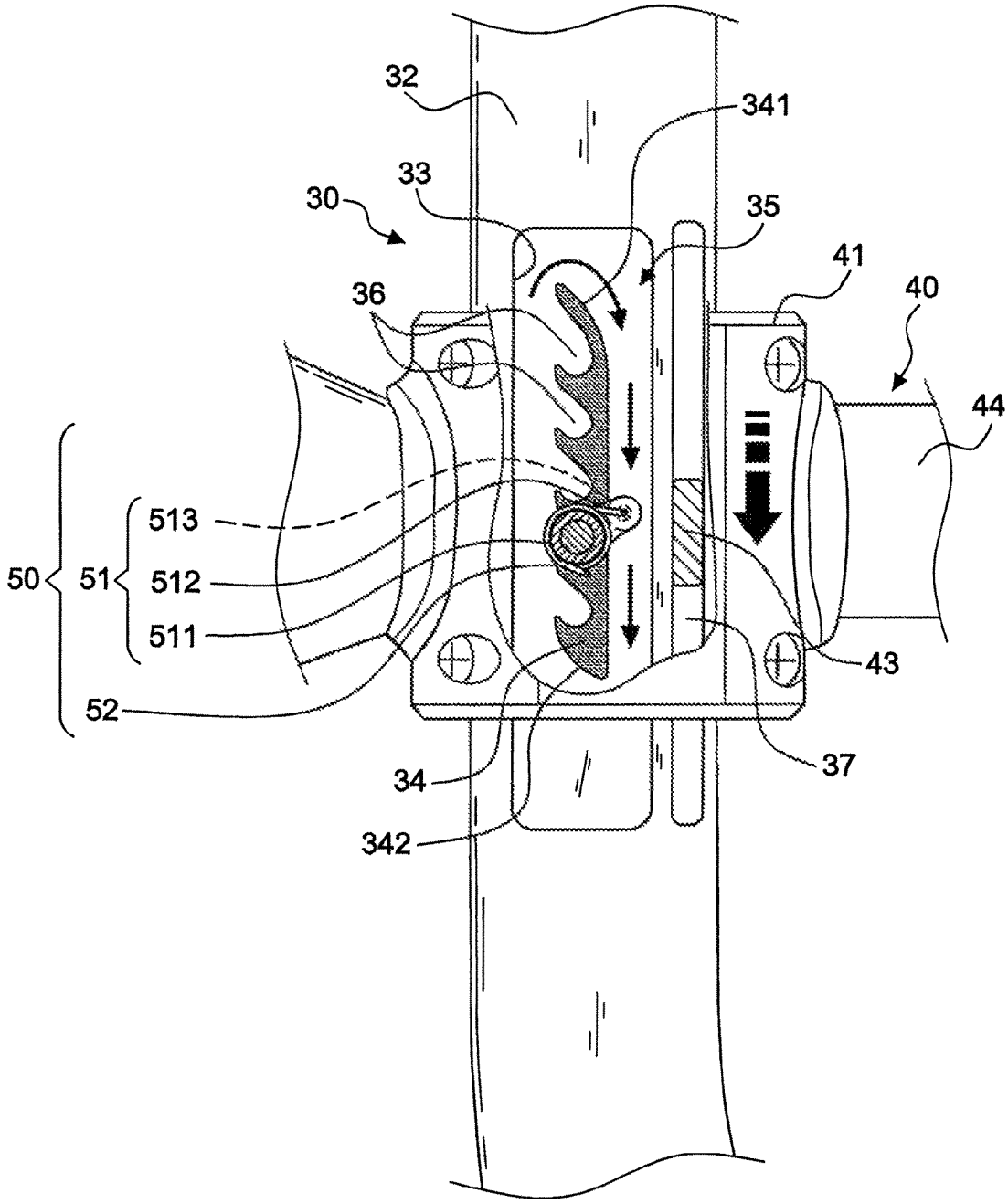
FIG. 12 is a schematic view showing that the engaging unit falls down.

First of all, as shown in FIG. 11, the backrest unit 40 is moved to the highest position. At that time, the crank 512 and the projection 513 of the engaging unit 50 are detached from the engaging teeth 36 at the external side and located at the top of the longitudinal projecting body 34. The top of the longitudinal projecting body 34 is constructed as a guide camber 341 inclined inward. Thus, the projection 513 moves along the guide camber 341 and enters into the internal side of the longitudinal projecting body 34. The turning slide 35 at the internal side does not have any teeth or obstacles such that the entire slide sleeve 41 naturally falls down (see FIG. 12) and drops back to the lowest position, as shown in FIG. 9. The bottom of the longitudinal projecting body 34 is constructed as a guide camber 342 inclined outward such that the projection 513 of the engaging unit 50 may be moved from the external side to adjust its height. As a result, the slide sleeve 41 is movable on the vertical portion 32 in the range marked by L for adjusting its height.

Based on the above-mentioned structure, the height adjustment may take place to achieve the optimal resting angle according to the different body shapes, personal requirements and needs of the users. In moving upward to adjust the height, an automatic engagement is achieved in the predetermined position. Moreover, an automatic return to the lowest position is achieved as well in reaching the highest position. It is done without any tools or control buttons and fulfills the requirements on the user-friendly operation and a practical use.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A device for adjusting the height of the seat back of an office chair, comprising:

a) a seat body having chair feet at a bottom thereof;

b) a frame body formed in an L shape with a vertical portion and a bottom portion, the bottom portion thereof being pivotally attached to a rear side of the seat body, the frame body having a left and right vertical portion both of which are parallel to each other and located at a position facing to a front of the the chair, a longitudinal slot being formed at the front or rear side of the vertical portions, a longitudinal projecting body being positioned at the center of the longitudinal slot such that an elongated ring-shaped turning slide is formed within the longitudinal slot by means of the longitudinal projecting body, one side of the longitudinal projecting body having a plurality of engaging teeth with engaging spaces between the teeth directed substantially upward;

c) a backrest unit mounted at the front side of the frame body and having at the rear side thereof two slide sleeves facing to the longitudinal slot of the frame body and movable up and down on the vertical portions, the slide sleeves each include a mounting hole at the side facing to the engaging teeth; and d) a engaging unit having an engaging body and a torsion spring, the engaging body having a shank and a crank at the front side of the shank, the end of the crank being provided with a projection insertable into the engaging spaces between the engaging teeth, the rear end of the shank fitting into the mounting hole of the slide sleeves, the torsion spring being mounted on the shank, the torsion spring having a front arm resting on the surface of the crank and a rear arm fixed at the periphery of the mounting hole of the slide sleeves, wherein the crank of the engaging body is subject to a rotational bias from the torsion spring such that the projection at the end of the crank contacts the side of the longitudinal projecting body when the slide sleeves are adjusted alternatively in an upward direction and a downward direction;

wherein, when the projection rises to the prearranged position, the projection is engaged into the engaging spaces between the engaging teeth by means of the rotational bias of the torsion spring;

wherein, when the projection rises to the top of the longitudinal projecting body, the projection rotates over the longitudinal projecting body to the side opposite to the engaging teeth, the slide sleeve falls with the projection freely sliding along the side opposite to the engaging teeth, whereby the height of the backrest unit is adjustable from a lower position to a higher position, and, when the projection reaches the highest position, the backrest unit automatically falls back to the lowest position, and the height adjustment may be done according to the requirement of the user once again.

2. The device for adjusting the height of the backrest of an office chair as recited in claim 1 wherein the top and the bottom of the longitudinal projecting body of the frame body are constructed as an inclined guide camber.

3. The device for adjusting the height of the backrest of an office chair as recited in claim 1 wherein the frame body includes an elongated groove beside and parallel to the longitudinal slot, and the slide sleeve includes a slipper corresponding to and fitting into the elongated groove such that the slide sleeve of the backrest unit can be stably and longitudinally movable on the frame body.

4. The device for adjusting the height of the backrest of an office chair as recited in claim 3 wherein the slide sleeve of the backrest unit consists of an external clamping portion and an internal clamping portion, and both sides of the external clamping portion are connected to a crossbar extending to an external frame of the backrest unit, and wherein, after the torsion spring is received within the mounting hole, the internal clamping portion is secured to the external clamping portion in such a way that the vertical portion of the frame body is clamped between the external and internal clamping portions.

5. The device for adjusting the height of the backrest of an office chair as recited in claim 4 wherein the external frame of the backrest unit is provided with two spring elements at the bottom thereof, and a waistrest is pivotally connected to the bottom of the spring elements such that the waistrest elastically rests on the spring elements and is swivelable to and fro by use of the spring elements.

6. The device for adjusting the height of the backrest of an office chair as recited in claim 1 wherein the shank of the engaging body has a positioning plug fitting into the mounting hole of the slide sleeve such that the shank may rotate on the positioning plug.

* * * * *